US005695245A

United States Patent [19]

Carlson et al.

[11] Patent Number: 5,695,245

[45] Date of Patent: Dec. 9, 1997

[54] ORTHOTIC SEAT

[75] Inventors: J. Martin Carlson, Edina; Joseph S. Bieganek, St. Cloud; Mark J. Payette, Hugo, all of Minn.

[73] Assignee: Tamarack Habilitation Technologies, Inc., St. Paul, Minn.

[21] Appl. No.: 547,575

[22] Filed: Oct. 24, 1995

Related U.S. Application Data

[63] Continuation-in-part of Ser. No. 328,430, Oct. 25, 1994, abandoned.

[51] Int. Cl.[6] ..... A61G 5/00

[52] U.S. Cl. ..... 297/314; 297/284.7; 297/353; 297/464

[58] Field of Search ..... 297/256.13, 284.7, 297/314, 353, 410, 464, 452.55

[56] References Cited

U.S. PATENT DOCUMENTS

| | | | |
|---|---|---|---|
| 326,184 | 9/1885 | White | 297/464 X |
| 527,056 | 10/1894 | Gilson | 297/464 |
| 638,197 | 11/1899 | Higgins | 297/357 X |
| 1,074,615 | 10/1913 | Folmer | 297/464 |
| 1,356,365 | 10/1920 | Hosmer | 297/464 |
| 4,819,278 | 4/1989 | Ramos | 297/464 X |
| 4,915,446 | 4/1990 | Darling et al. | 297/250 |
| 5,110,182 | 5/1992 | Beauvais | 297/216 |
| 5,228,747 | 7/1993 | Greene | 297/284.3 |
| 5,378,045 | 1/1995 | Siekman et al. | 297/DIG. 6 X |

OTHER PUBLICATIONS

Snug Seat, Inc. Brochure, "The Zebra Push Chair", Snug Seat, Inc., Matthews, NC, 1991.

Snug Seat, Inc. Brochure, "Our Seating Systems Are Designed With The Caregiver In Mind", Snug Seat, Inc., Matthews, NC, 1991.

Snug Seat Incorporated Brochure, "Snug Seat 1 Seating System", Snug Seat, Inc., Matthews, NC, 1991.

Snut Seat, Inc. Brochure, "The Roadrunner Mobility Base", Snug Seat, Inc., Matthews, NC, 1992.

*Otto Bock Modular Orthotic Seating System II*, "An Adaptive Seating System", publication date unknown (admitted as prior art).

*Otto Bock Orthopedic Industry*, "New Wheelbases", Feb. 1991.

*Otto Bock Adult moss II*, "Adult Modular Orthotic Seating System II", Feb. 1991.

Kid-Kart, Inc. Brochure, "kid-kart Kid-Care Mobility Products", Kid-Kart, Inc., Belgrade, MT (admitted prior art).

Kid-Kart, Inc. Brochure, "kid-EZ Spica Cast Retrofit", Kid-Kart, Inc., Belgrade, MT (admitted prior art).

Kid-Kart, Inc. Brochure, "MPS—Multi-Positioning System", Kid-Kart, Inc., Belgrade, MT (admitted prior art).

Kid-Kart, Inc. Brochure, "the kid-EZ tilt/recline model", Kid-Kart, Inc., Belgrade, MT, Nov. 1993 (admitted prior art).

Kid-Kart, Inc. Order Form, Kid-Kart, Inc., Belgrade, MT (admitted prior art).

Mulholland Positioning Systems, Inc. Brochure, "Growth Guidance System with Step Release Tilt-In-Space & Flip Down Abductor", Mulholland Positioning Systems, Inc., Santa Paula, CA (admitted prior art).

(List continued on next page.)

*Primary Examiner*—Peter R. Brown

*Attorney, Agent, or Firm*—Westerman, Champlin & Kelly, P.A.

[57] ABSTRACT

A modular orthotic seat is made up of individual shells or modules that are adjustably connected together for accommodating changes in size of the user. The modules include a pelvic module for support of the thighs, pelvis and sacrum, a thoracic module for support in the thorax and lumbar regions, and a cervical-head support. The modules are mounted on a strut that permits adjustment between the modules. Suitable bedding or padding can be used for final custom fitting. An adjustable seat pan is provided for permitting adjustment of the supporting seat to accommodate angular variations of the pelvic regions of the user.

17 Claims, 7 Drawing Sheets

OTHER PUBLICATIONS

Mulholland Positioning Systems, Inc. Brochure, "Sprite Tilt–In–Space", Mulholland Positioning Systems, Inc., Santa Paula, CA (admitted prior art).

Mulholland Positioning Systems, Inc. Brochure, "Designs for the Development of Functional Skills", Mulholland Positioning Systems, Inc., Santa Paula, CA (admitted prior art).

Mullholland Positioning Systems, Inc. Order Form, "Mulholland Adaptive Shoulder Pad/Neckrest Assembly", Mulholland Positioning Systems, Inc., Santa Paula, CA (admitted prior art).

ORTHOTIC SEAT

CROSS REFERENCE TO RELATED APPLICATION

This is a Continuation-In-Part of application Ser. No. 08/328,430, filed Oct. 25, 1994 for ORTHOTIC SEAT now abandoned.

BACKGROUND OF THE INVENTION

The present invention relates to a shell that can be used as a postural orthopedic seating system capable of adjustment to provide necessary head, cervical, thoracic, lumbar, pelvic, hip and thigh supports, particularly for growing children, and which can be adjusted to accommodate growth, as well as being shaped to provide support and comfort for a person utilizing the seat. In a variety of sizes, this invention is also useful to address the orthopedic and decubitus prevention needs of people with impairments acquired during adulthood.

At the present time, anatomically supporting orthopedic seats for severely impaired children are custom fabricated and fitted to provide necessary support and restraint. Usually a custom formed shell is utilized that extends from a pelvic portion, up through a thoracic support portion and may include support for the head and cervical spine of the user. However, as growth occurs, a new shell has to be made with regularity, thereby increasing the cost and also the availability of the highest quality anatomically supportive orthopedic seats for persons that could benefit from such supports. Custom built shells are comfortable, and can be made to fit well, but they are time consuming to make and enlarging the shell dimensions differentially in different areas to accommodate growth requires considerable time and very specific skills.

Other types of anatomical chairs have been sold. For example, a chair sold under the trademark SNUGSEAT by Snugseat Incorporated has a unitary shell that requires substantial amounts of padding in order to provide for appropriate fit, and it too, has limitations in its supporting capabilities, as well as limited capacity to accommodate growth. The Snugseat design is typical of many commercially available designs which utilize a grossly oversize shell frame. Fitting of the seat involves either a "building block" or a sculpting operation to the foam insert components. Close anatomical support to the user's thorax does not leave the arms free.

Mulholland Positioning Systems, Inc. of Santa Paula, Calif., sells a chair that folds and provides a frame that permits adjustment of some support pads on the large frame. The Mulholland design is adjustable through a multiplicity of brackets, columns, and beams extending some distance from the child. That design offers adjustability but the child appears to be occupying a "seating machine". It also does not provide the firm, form-fitted support required for some orthopedic goals.

The need exists for a modularized shell system that can be adjusted for accommodating growth, as well as being adjustable for proper fit, using substantially standard modules for construction. A system which can provide close anatomic support as necessary for orthopedic control, which leaves arm motion free, and which does not draw attention away from the child is desired.

SUMMARY OF THE INVENTION

The present invention relates to a modular shell system used for constructing orthotic seats for a wide range of sizes and skeletal configurations, wherein different size modules can be intermixed and independently adjusted as desired. The modular shell system of the present invention includes adjustable sections that can be moved relative to each other as user growth occurs. The shells have adequate space for some padding variations which may be dictated by the patient's needs.

In particular, the present invention provides at least two modules, including a pelvic-seat shell module that is molded to provide a support surface for the pelvic/thigh bedding, and having side walls and a back wall for providing lateral and rear support. A suitable adjustable foot plate can be attached to the seat module for supporting the feet of a user as well.

The pelvic shell module supports an upright strut or struts secured to the rear of the pelvic shell module and slides into a provide groove in a thoraco-lumbar module that has a back wall and side walls that fit along the lateral sides of the thorax of a user. The adjustment in vertical direction along the support strut permits placement of the thoracic module in the proper location for providing the needed support, and also provides for adjustment as the user grows. That portion of the strut which is spanning the separation between the two modules can be bent to easily alter the relative alignment between pelvis and thorax as required by the patient. When needed a head-cervical support can be adjustably mounted on the upright strut as well, and it can have slots for shoulder straps and for mounting padding for supporting the head laterally.

The thoracic shell module in particular is formed from a moldable thermo-plastic material, so that the side or lateral supports can be heated and formed to closely fit a user, as desired.

The head-cervical shell module adjustment along the upright strut is relative to both the thoracic shell module and the pelvic shell module, to accommodate needed initial positioning and to accommodate changes for growth. The upright strut is capable of being bent into configurations to fit unusual skeletal conditions, including bending the upright strut rearwardly (or forwardly) to move the thoracic shell module to the rear (or forward) relative to the pelvic module. The strut can be twisted as well to accommodate desired orientations of the modules. In use, however, the strut is quite sturdy and provides adequate support without undue flexibility.

For patients with a "pelvic tilt", that is, misalignment of the pelvis relative to the spine, an adjustable seat pan is provided. The adjustable seat pan can be adjusted about fore and aft and lateral axes to compensate for pelvic tilt in directions from a generally horizontal plane. Some height adjustment relative to the support shell frame is also provided.

The shell modules are made in several standard sizes, and the sizes of different modules can be intermixed, so that, for example, a large pelvic module can be used with a smaller thoracic shell module.

This particular design provides structural integrity and adjustability by means of a unique combination of modules mounted adjustably on a system of close fitting struts. Further, the pelvic tilt adjustment accommodates requirements of tilted seat support. The result is an orthopedic seating system which, in addition to the other features, fits so close to the user's body profiles that it is much less bulky, less noticeable as an aid, and therefore cosmetically superior. The two-axis adjustability of the seat pan relative to the rest of the seat, particularly with respect to the base module, allows for specific pelvic alignments necessary to accommodate orthopedic deformities of the spine/pelvis/hip area and/or to accommodate alignments judged to be advantageous for other therapeutic reasons.

DETAILED DESCRIPTION OF THE PREFERRED EMBODIMENTS

Figure 2:
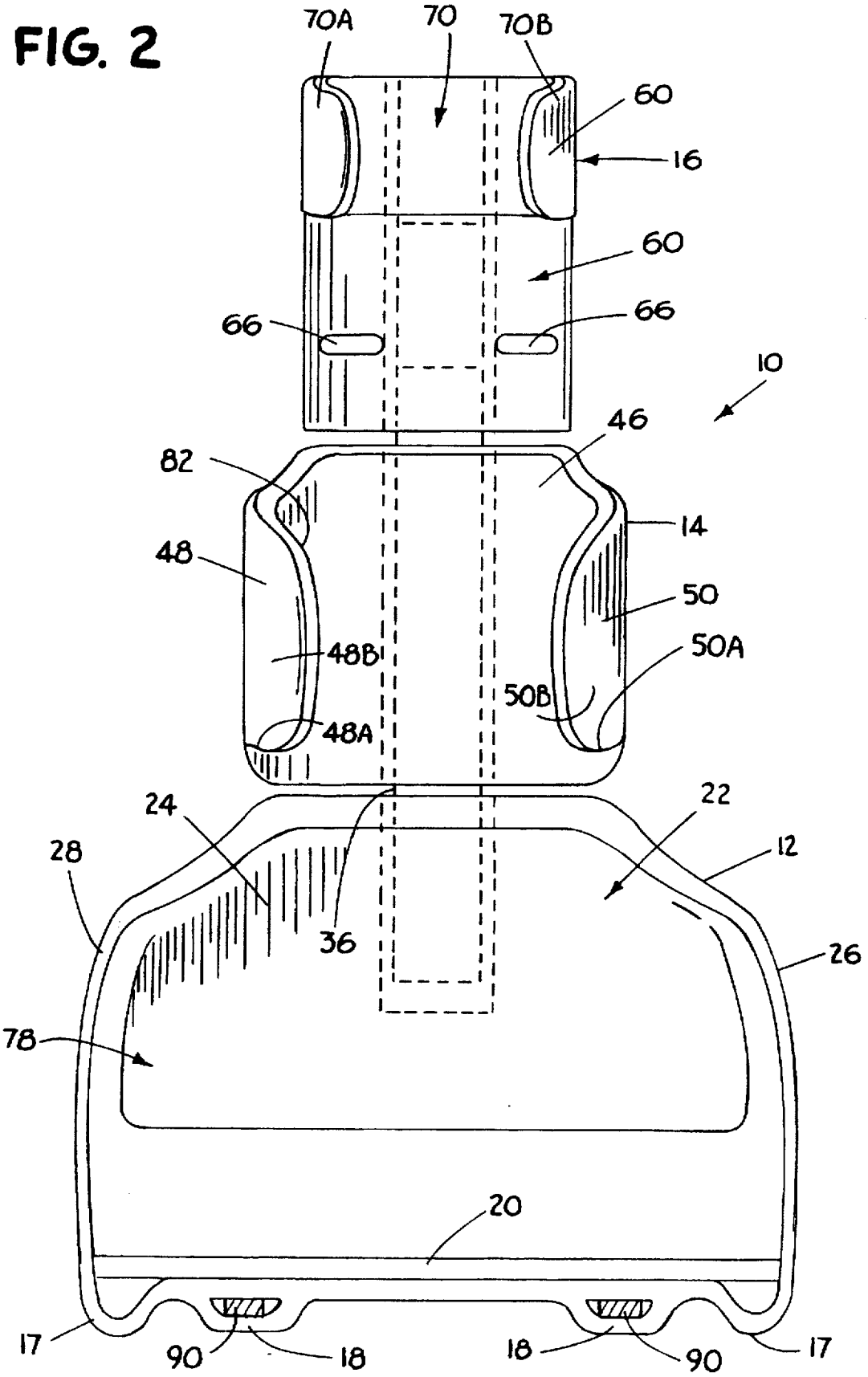
FIG. 2 is a front elevational view of an orthotic seat of the present invention having a pelvic module, a thoracic module and a cervical support module assembled together.

Referring to FIG. 2, the assembly of the orthotic seat indicated generally at 10 is illustrated. The seat is modular, including a pelvic or seat-bottom shell module 12, a thoraco-lumbar shell module 14, and a cervical-head support module 16. The pelvic or seat-bottom shell module 12 includes a lower support base 17 that can be formed into a solid wall, or skirt type which can be braced with suitable cross braces. The base 17 has a support edge, which can be rested on a surface. A pair of guide sleeves 18 are molded in place with supporting straps for a foot rest or size change module. Normally, this type of an orthotic seat will be used in a chair, a wheelchair, or some other exterior support.

Figure 3:
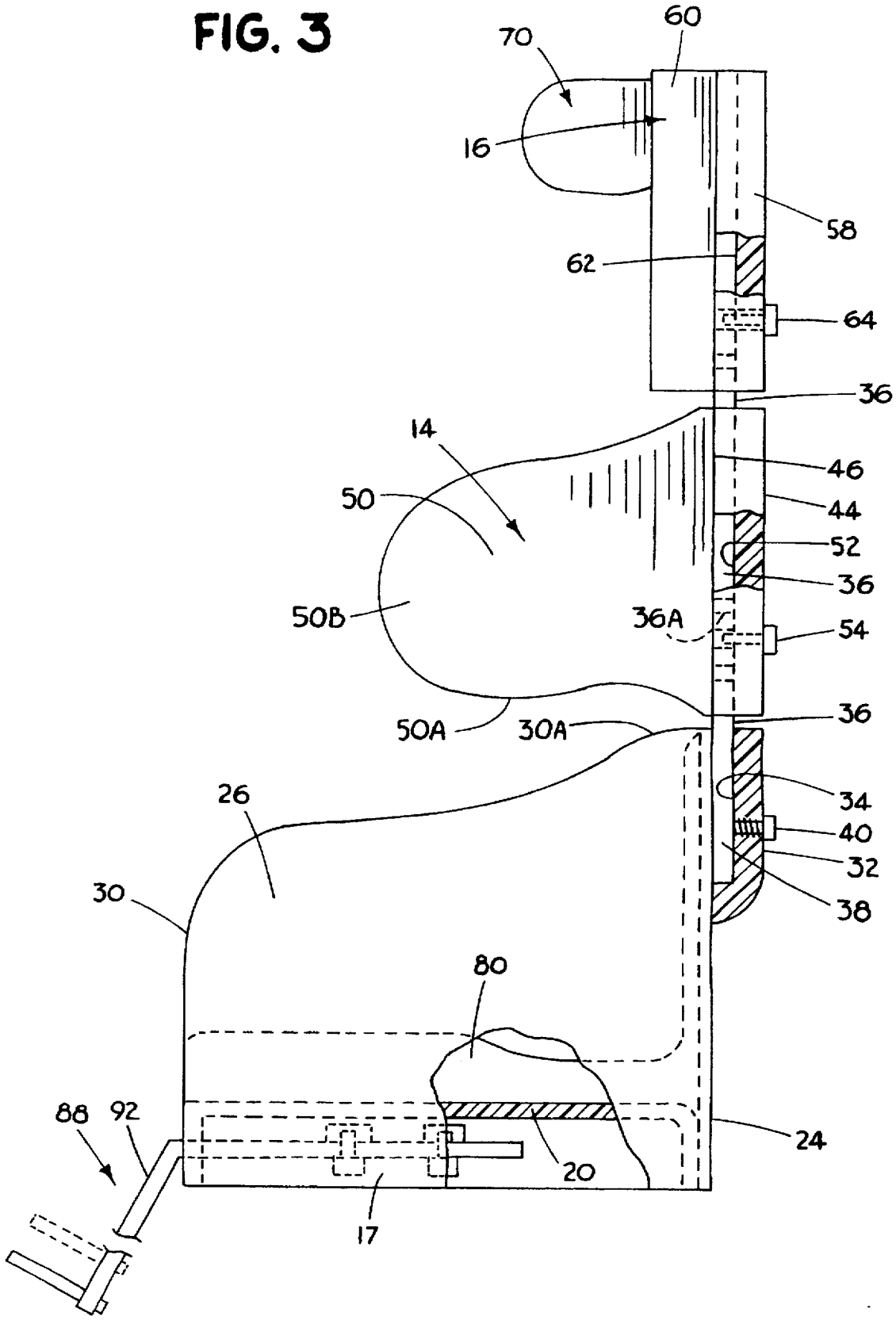
FIG. 3 is a side elevational view of the device in FIG. 1.

The pelvic shell module 12 further includes a seat platform wall 20, that is made of a suitable size, and an upright wall assembly 22 extending up from the seat platform wall 20, including a rear wall portion 24. Side wall portions 26 and 28 are also provided. The pelvic shell module 12 is molded as a single unit, and it can be seen that the side wall portions 26 and 28 have gently curved front edges 30 that insure that there are no sharp corners or bumps that may be unsafe. The rear wall 24, on its exterior, as shown, has a molded in channel 32 that has an interior passageway or socket shown at 34 in FIG. 3. The passageway 34 is of size to receive an upright or vertical strut 36 that is of suitable size to provide adequate rigidity and yet may be bent if necessary. Normally the upright strut 36 would be a bar of aluminum or some other material that did not rust or corrode. Two or more channels 32 and struts 36 can be used for larger designs. The strut has an end portion indicated at 38 retained in the passageway 34. A suitable fastener or fasteners shown schematically at 40 in FIG. 3 are used for locking the upright strut 36 in position within the opening 34 of the socket 32.

The strut 36 extends upwardly above an upper edge 30A of the rear wall 24 of the pelvic or seat module. The strut 36 is passed through a suitable formed sleeve or channel 44 on a rear wall 46 of the thoracic-lumbar shell module 14. The thoraco-lumbar shell module 14 also has integrally molded lateral side support walls 48 and 50, respectively that, as shown, are curved and trimmed for a suitable fit and clearance, including upwardly curved lower edges 48A and 50A extending toward the rear wall 46 from outer ends 48B and 50B. The outer ends 48B and 50B gently curve inwardly toward each other, that is toward a center plane. The outer ends 48B and 50B of the side walls also are rounded off with large radius curves.

The thoracic shell module 14 is slidable along the upright strut 36. The channel 44 has an interior opening 52 slidably receiving the strut 36. The thoracic shell 14 can be secured at a desired location along the strut 36 through the use of suitable cap screws, such as that shown schematically at 54. The cap screws thread into the outer wall of the channel 44 and bear against the strut 36. If adjustment at desired intervals along the length of the strut 36 all that is needed is a series of holes 36A which may be formed in the strut 36 to receive a pin or threaded bolt passing through the walls of the channel 44.

As shown, the strut 36 extends through the channel 44, and also mounts into a sleeve or channel 58 that is part of the cervical-head support or restraint module 16. As shown, the cervical-head support module 16 is a generally flat member 60 on which the sleeve 58 is formed. The end portion of the strut 36 extends into an opening or slot 62 formed in the sleeve 58. The position of the cervical-head support module 16 can be maintained using a suitable set screw 64, or by pinning the unit in place at desired positions through use of suitable holes in the strut 36 and the cervical-head support.

The cervical-head support module 16 can have openings or slots shown at 66 formed therethrough for receiving and retaining straps for retaining the head of a user of the orthotic seat 10 in a desired position. Padding can be added, as desired, including suitable lateral supports for holding the head from side to side movement. The type of supports used are well known, vary with the disability of the child, and are not specifically shown as to various forms. As shown, a suitable head pad 70 can be supported on the board member 60 with fasteners, such as hook and loop fasteners sold under the trademark VELCRO, or by snaps or other securing devices.

The U-shaped head support 70 is a foam pad covered with a fabric so that a head positioned between the side portions 70A and 70B will be held in position.

Figure 1:
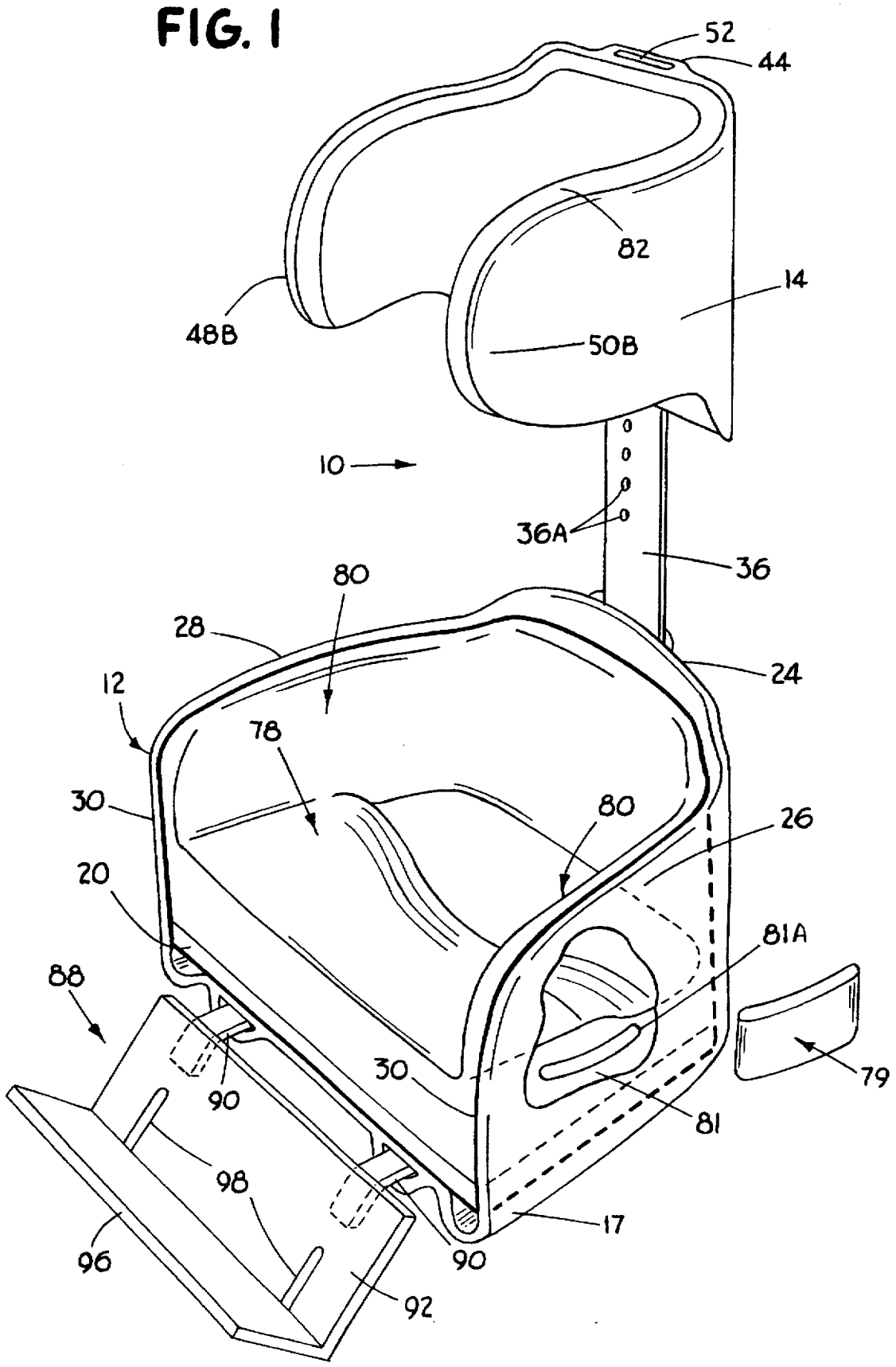
FIG. 1 is a perspective view of a seat made according to the present invention using a pelvic module and thoracic module.

FIG. 1 is an enlarged perspective view of the seat or pelvic shell module 12 and the thoracic shell module 14, and illustrates that the strut 36 and holes 36A for providing adjustment for the thoracic shell module 14. Also, the bedding or padding indicated at 78 is illustrated in position supported on the seat wall 20 of the pelvic shell module 12. The bedding can be foam cushions formed to fit the user's skeletal contours. The bedding also can comprise adjustable padding where small inserts of foam or other pad materials are placed under an outer covering (fabric) for adjusting the fit and conformability of the bedding to the user, as will be described.

The lateral side walls 26 and 28 provide lateral support for a person sitting in the pelvic shell module, and the lateral sides also can have bedding indicated at 80 mounted on the side walls or as part of lateral (and posterior) extensions of the under bedding in a suitable manner, again such as with hook and loop or snap fasteners, or the like.

The adjustment pad shown at 79 in FIG. 1 is typical of pads that can be used to provide close fitting support and to accommodate size difference between the patient and the various standard module size configurations. As the child grows, the pads 79 may be removed or thinned to inexpensively accommodate growth or weight gain. The pad 79 can be inserted into an outer covering 81 of the bedding through a slit or pocket opening 81A. Such auxiliary padding of various shapes, and covered or uncovered can be used in pockets or merely placed between the bedding and the shell. The auxiliary pads can be used with the thoracic and cervical pads as well.

The thoracic shell module 14 is shown in FIG. 2 with padding 82 in position. It can be held in place in a suitable manner. The padding 82 along the sides of the thorax can be reduced in thickness, and even eliminated for more direct support against the thorax of a user. The outer end portions 48B and 50B can be molded or formed by using a suitable thermo-plastic material for forming the thoracic shell module 14, and then custom fitting the sides by heating and forming to fit a user.

Figure 4:
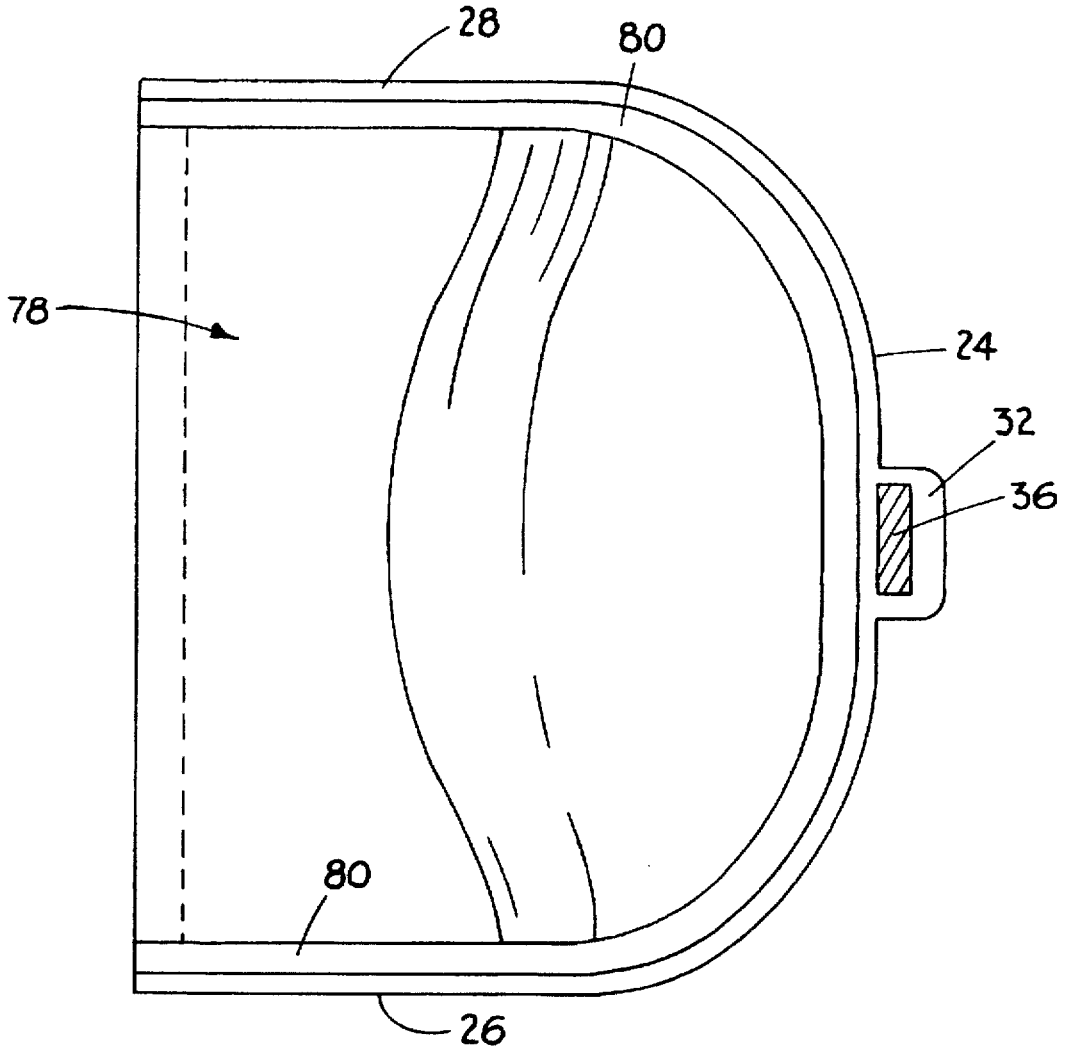
FIG. 4 is a top plan view of a pelvic module made according to the present invention.
Figure 5:
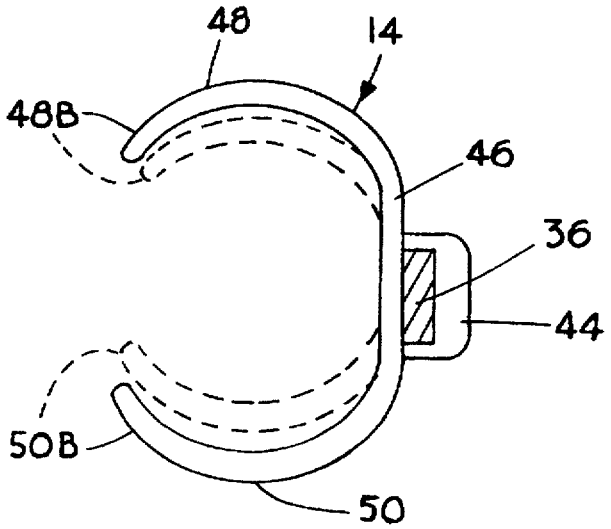
FIG. 5 is a top plan view of a thoracic support made according to the present invention.

FIGS. 4 and 5 are top plan views of the pelvic shell modules and thoracic shell modules, respectively. It also can be seen there that the side wall portions 48 and 50 of the thoracic shell module 14 can be bent to positions to change the lateral size of the thoracic shell upon suitable heating of the material as shown illustratively in dotted lines. The outer end portions 48B and 50B also can be curved in at different amounts from each other for custom fitting on each side if non-symmetrical support is desired.

One of the advantages of the present invention is that different size pelvic shell modules can be made, for a range of individual sizes, and then the bedding or padding 78 can be custom fit for individuals within a particular size range. Thus, instead of having to custom fit each shell, as was needed because of the previous molding of unitary seat assemblies, having standard size pelvic shell modules in several different sizes will provide a wide range of support for individuals requiring the orthotic seat support, since the pelvic shell module is a "receiver" for the bedding unit. There are open options for the bedding to address a variety of needs and professional interpretations of what is best for the child. The bedding needs only to fit the shape and size of the "receiver" module. Likewise, the thoracic shell modules can be made in several different sizes. Then either padding applied, for custom fit, or the side walls of the thoracic shell module can be molded to fit an individual. The vertical height of the thoracic shell module relative to the pelvic shell module is easily adjusted utilizing support strut 36, or other types of adjustable vertical supports. Also, the alignment of the thoracic support module may be adjusted, as described earlier, by bending and/or twisting the strut 36. The advantage of a single strut is that such alignment adjustments are greatly simplified.

The same is true with the cervical-head support module, in that the cervical-head support module can have custom pads attached to it and it can be vertically adjusted to fit the user.

The seat assembly 10 can be used as shown in FIG. 1, without a cervical-head support, if desired. As can be seen, there is a substantial amount of vertical adjustment between the upper edges of the pelvic shell module and the thoracic shell module.

By having modules that can be mounted onto a common support, such as the strut 36, if the physical size of a user of the orthotic seat is proportioned differently than what a standard seat would be, a small thoracic shell module can be used with a large or medium sized pelvic shell module, and the vertical height adjustment can easily be made as explained. While the term "thoracic" shell module has been used for the module 14, it in fact can also be a lumbar support, and can be termed a thoraco-lumbar module as well. The cervical-head support module also may be termed an occipito-cervical module.

The pelvic module supports the thighs, pelvis and sacrum of the user. The heating and forming of the thoracic module can be used for accommodating spine alignments, where the thorax is displaced laterally from the pelvic center line, and as was stated, the strut 36 can be bent in fore and aft direction and even can be bent laterally if necessary for fitting.

The pelvic shell module provides many fit and support options. Preshaped or custom shaped foam pads can be provided in the bedding for a full variety of options including the firmness of the foam, such as firm foams, soft visco-elastic foams, or gels, depending on the support and cushioning needs of the user. The modular shell also provides for a more open design than previous unitary shells because of the spacing between the modules that provide for better air circulation and a more unobstructed view of the patient. The bedding can be covered with any type of cover that is desired. The bedding pads for individual modules are easier to cover than pads for an entire molded shell that includes a full length support for the back and head. The insert pads 79 can also be made of any desired materials.

The side wall members of the thoracic shell module can be independently mounted onto the back wall, so that they can be adjusted independently as desired. As shown in FIGS. 2 and 3, partially cut away, a foot support indicated at 88 can be molded to be L-shaped, and can have a pair of horizontal support straps 90 supporting a depending wall 92. The support straps are adjustable in and out in guides in the pelvic shell and by providing slots in the straps 90. Cap screws extend through the slots in straps 90 and thread into bosses formed on the bottom of seat 20. The slotted straps 90 provide in and out adjustment of the foot support. Up and down adjustment also can be provided by adjusting a step 96 along slots 98 on wall 92 with cap screws extending through the slots and threaded into the back of the step.

The foot support 88 can be at a desired angle relative to the seat 30. Padding can be provided on wall 92 as well. The bedding that is used on the seat 20 can be provided with openings for the straps 90.

Another feature of the invention is that the seat 20 can be trimmed as needed for fitting a particular patient or user initially, so that the distance between the back wall and the front edge of the seat can be changed. Further, it can easily be understood that a continuous strut 36 is not necessary, and more than one strut can be used. Two struts could be used for supporting the thoracic module relative to the pelvic module, and a single strut used between the thoracic module and the cervical-head support module, for example. The fitting method comprises providing a multiplicity of standard sizes of the pelvic support module and the thoracic support module, and selecting one size of each module adapted for the intended user. The modules are supported relative to each other. Custom bedding is than used in the pelvic support module for supporting and fitting the user, and padding is also added in the thoracic support module. The vertical adjustment between the modules is made for fitting also. The side walls of the thoracic support module can be formed as part of the fitting process. Also, the auxiliary pads can be inserted as needed in both modules. The cervical-head support module can be added and adjusted for final fitting. If desired, the strut 36 can be bent at an angle as shown in FIG. 3 to fit various modules to the patient.

Figure 6:
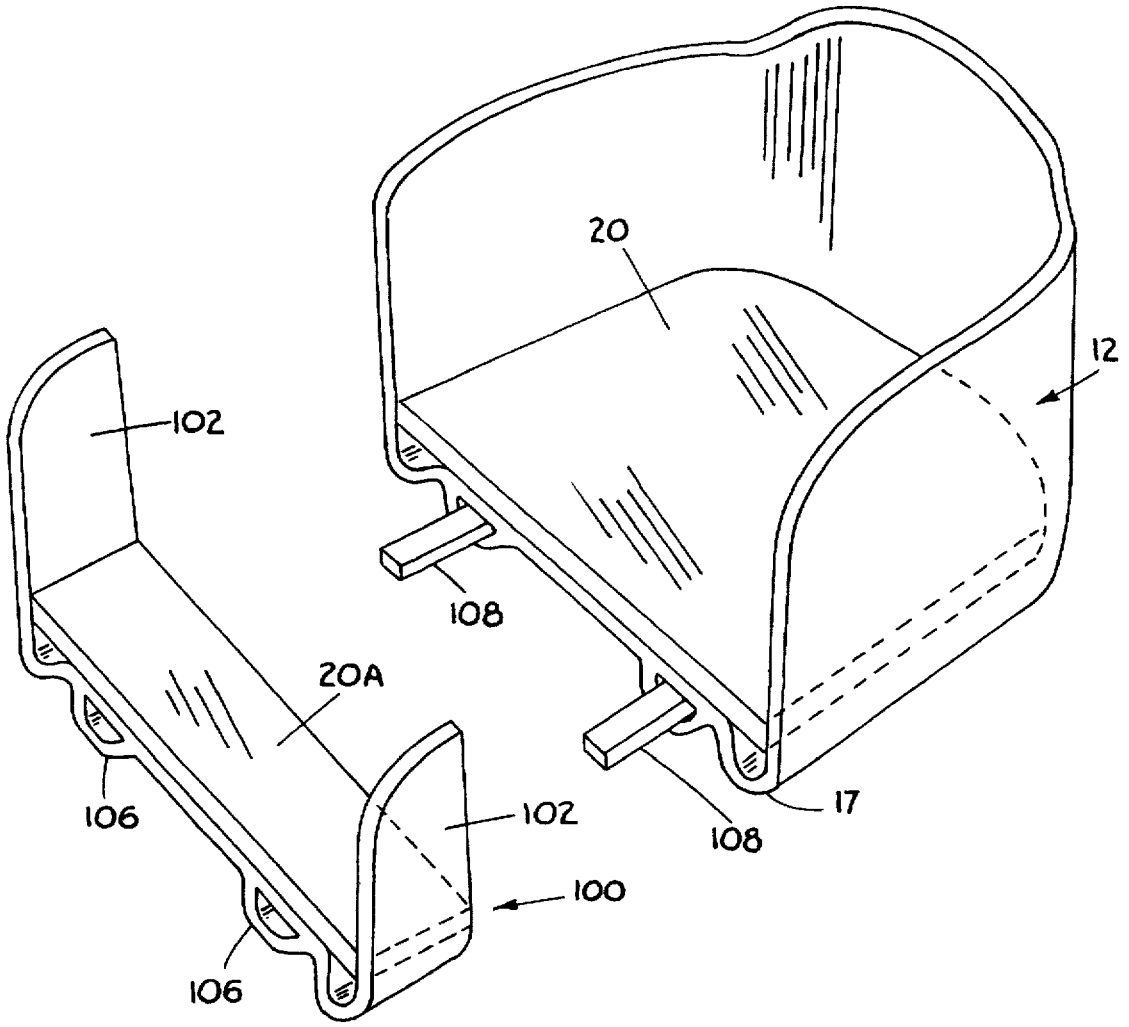
FIG. 6 is a perspective exploded view of a pelvic module with a length extension member illustrated.
Figure 7:
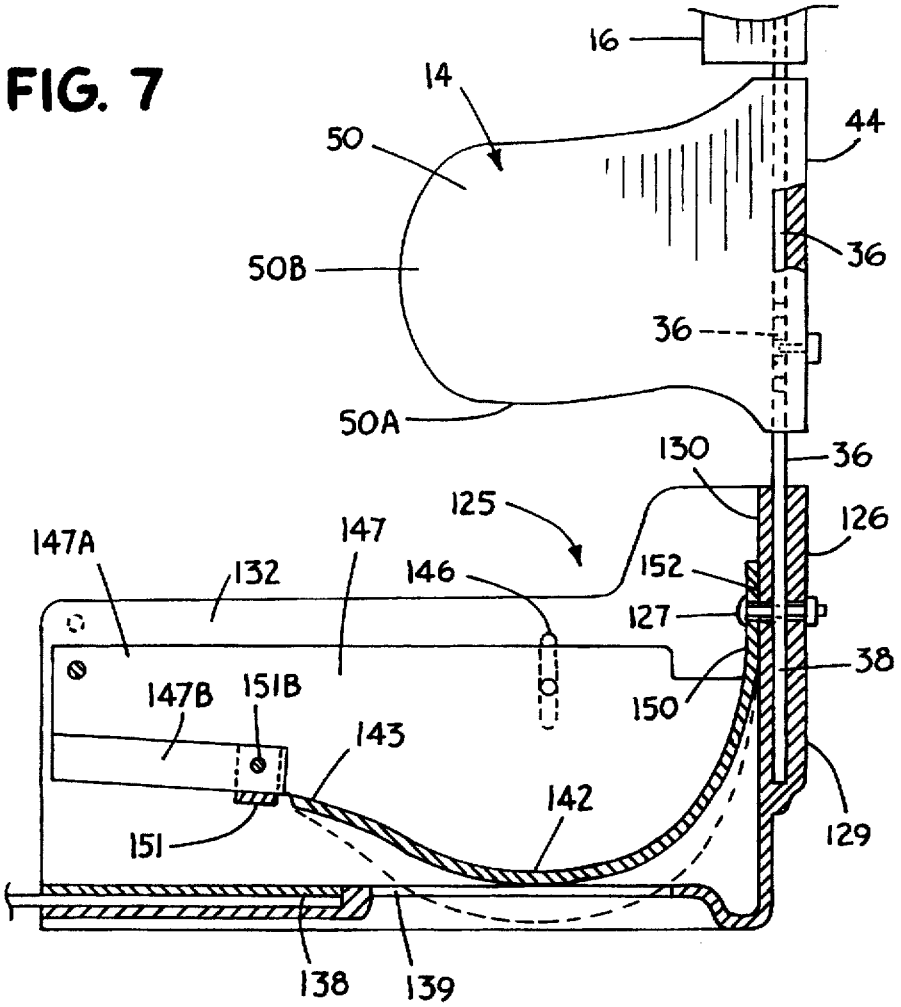
FIG. 7 is a side elevational view of a modified form of the invention having an adjustable seat pan in the pelvic module to accommodate pelvic tilt.

As shown in FIG. 6, the pelvic shell module 12, which is made according to the present invention and is shown without any bedding in place, desirably has adjustments for the length of the seat 20 and the bedding itself, for accommodating variations, and growth of thigh length. The anterior-posterior "depth" of the seat 20, is adjustable as shown in FIG. 6 by providing an extension piece 100, that can be made to replicate the forward end of the seat 20. The seat 20 supports the bedding. The extension piece 100 includes a pair of upright walls 102 that mate with the side walls of the shell module 12, and a floor extension 20A that will mate with the forward edge of the seat 20.

Suitable channels shown at 107 are made to receive bar support members 108, and can be clamped in place on the bar support members. The bar support members 108 are held as the supports 90 are held, and by securing the seat extension 100 to the bar, the seat extension 100 can be held tightly in place. The securement can be with suitable set screws or pins acting through the channels 106.

The side walls 102 can be curved as shown at desired forward edges, and can be made the same height as the side walls for the pelvic shell module 12.

Front portions of the seat can be cut off from a shell as the shell or bedding are trimmed back for proper length during fitting. The seat portion that is removed can form a seat extension if needed later for growth. Another way of providing seat extension 100 is to form the extension separately for a particular arrangement that is desired. Seat extensions can be made in several widths so a substantial range of adjustments are possible.

A second form of the pelvic shell module useable alone or with other modules of the present invention is illustrated in FIGS. 7, 8, 9 and 10. The cervical head support module 16 and the thoraco-lumbar shell module 14 are constructed as previously explained, and are therefore shown in FIG. 7 in place with the same numbers as in the previous form of the invention. However, the pelvic shell module or support frame 125 is modified to incorporate a pelvic tilt feature for custom fitting the seat to a user with or without the other modules. A channel 126 receives the end portion 38 of the strut 36 used for supporting the modules 14 and 16. The channel 126 is formed in a sleeve 129 that is molded onto a back wall 130 of the pelvic or seat bottom shell module 125. In all forms of the invention, one or more sleeve 129 and support strut 36 may be used. The pelvic or seat bottom shell module 125 includes side walls 132 and 134 which are integrally molded to join the rear wall 130.

The pelvic support module 125 has a bottom wall 138 with a cut out or opening 139 that is made of size to permit a recessed bottom wall portion 142 of a tilting seat insert pan 144 to protrude through the opening 139, and form a seat bottom for the user.

The seat insert pan 144 is made so that it can be adjusted for "pelvic tilt". The side wall 132 of the pelvic module has a first slot 146 therein, and the side wall 134 has a second slot 148 formed therein.

The seat insert pan 144 bottom wall portion 142, is joined to a front bottom wall portion 143 that is for supporting an occupant of the pelvic module 125. The pan 144 has molded side walls 147 and 149 that join the bottom wall 142, and which are molded to rear wall 150. The rear wall 150 has an adjustment tab 152 protruding up from the general level of the wall, and the adjustment tab 152 has a slot 154 therein.

The front ends of the side walls 147 and 149 have portions 147A and 149A that project farther forward than the front portion 143 of the bottom wall, and have integral offset flanges 147B and 149B that form retainer recesses 147C and 149C. The front wall portion 143 of the seat bottom can be extended with thigh support components 151. Holes can be drilled (or provided) through the flanges and the ends 151A for receiving fasteners 151B that hold the thigh support components 151 in position. The thigh support extension components 151 extend across the front of the seat bottom wall. The thigh support extension component 151 may take the form of bars, tubes, or other suitable cross section shapes suitably attached to the flanges 147B and 149B. When in place the holes can be drilled and the parts held with fasteners, the thigh support components (one or more can be used) will provide extra length for the seat and thus provide thigh support. Several thigh support components 151 can be added if desired to extend the seat out even with the ends of the side walls. The components 151 are made strong enough to provide support.

The seat pan side wall 147 has an aperture or opening that aligns with the slot 146 for a fastener 156, and the side wall 149 has an aperture or opening that aligns with the slot 148 for a fastener 158. The fasteners can be small bolts that are tightened in place.

Also, the forward portions 147A and 149A of the side walls 147 and 149 have holes drilled through them. When the proper angle and position is determined for the seat pan for a particular child, the holes are also drilled through the side walls 132 and 134 of the pelvic shell module. Fasteners 132A and 134A pass through these openings to secure the front ends of the seat pan 144 in place. The holes can be drilled in place as needed, so only one hole is shown.

The rear wall 130 of the pelvic shell module 125 has an aperture that aligns with the slot 154 to receive the fastener 127, which passes through the sleeve 129, the strut 36, the rear wall 130 and through slot 154, for tightening the seat pan and wall 130 together at the rear.

Figure 8:
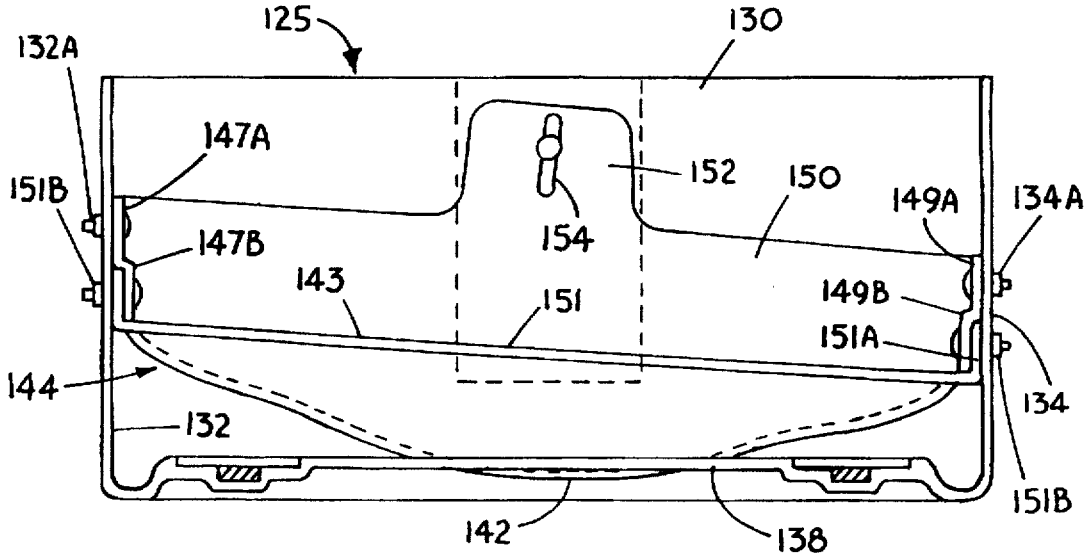
FIG. 8 is a front view of the pelvic seat pan and pelvic module of FIG. 7.
Figure 9:
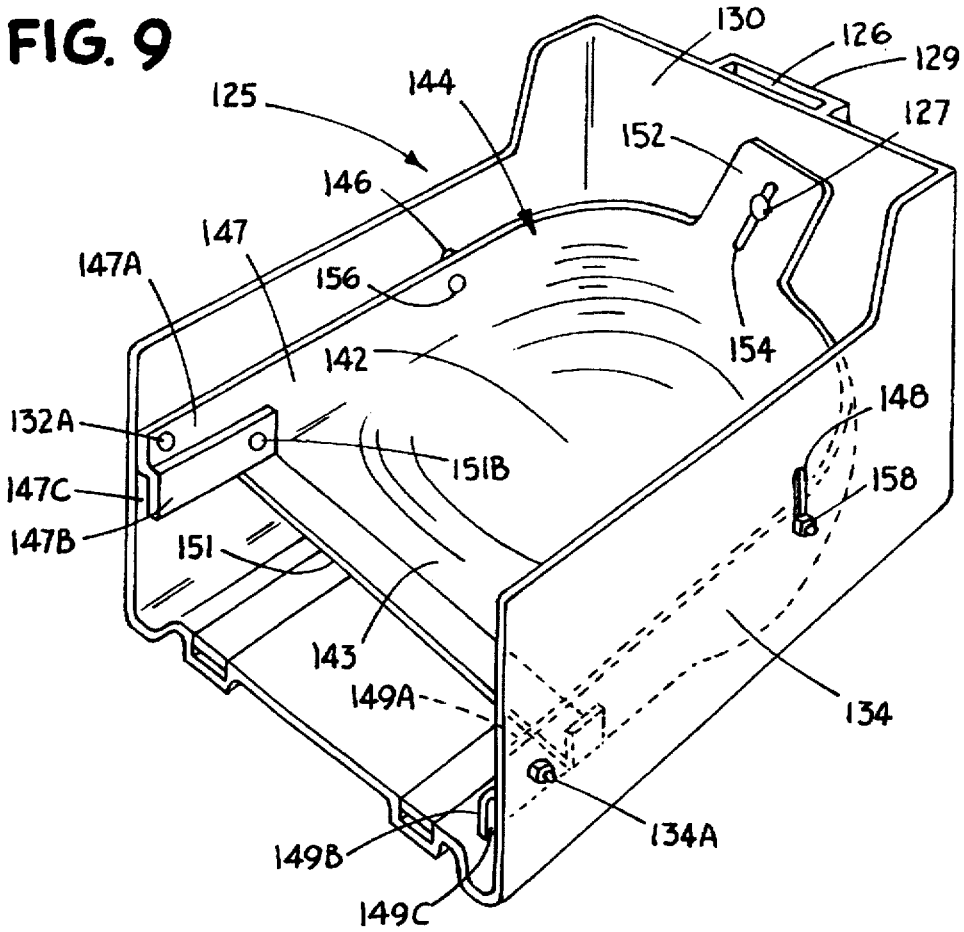
FIG. 9 is a perspective view of the device of FIG. 8.
Figure 10:
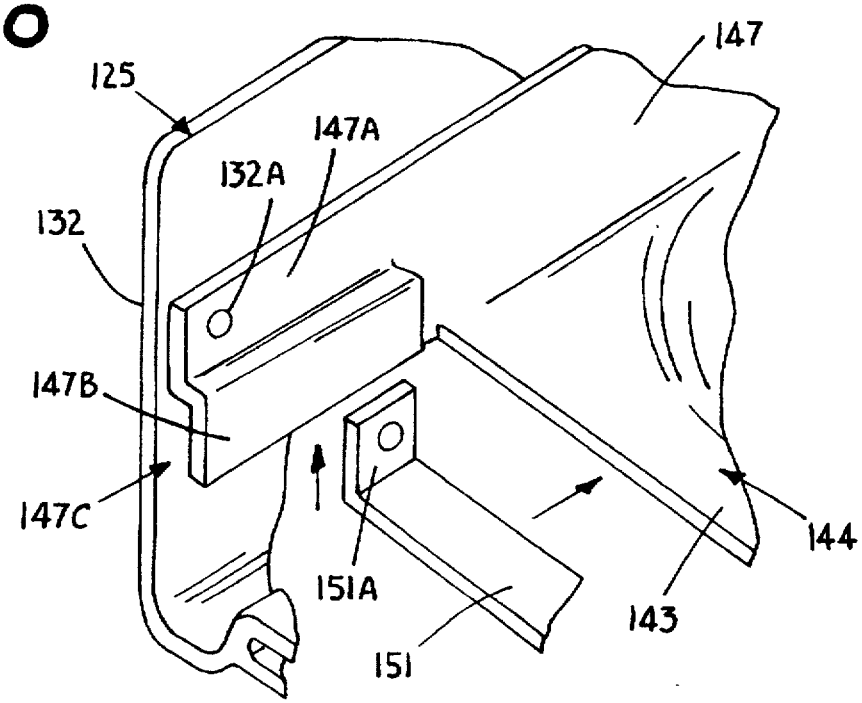
FIG. 10 is a perspective view of a thigh support strip that can be added to the front of the seat pan of FIG. 7.

The apertures in the side walls 147 and 149 hold suitable threaded fasteners that have relatively smooth heads and can be used with wing nuts on the exterior of the pelvic shell module 125 for tightening the pelvic shell seat insert pan 144 in position. The pelvic seat insert pan can be adjusted with a substantial amount of tilt laterally and also with a reward or forward slope. As shown in FIG. 8, the seat pan 143 can be tilted as illustrated in the solid line position or tilted in the opposite direction. The side wall slots in the pelvic support module are sufficiently long to permit the desired lateral inclination of the seat pan 144. The seat pan 144 will pivot about the bolt or pan 127. The forward tilt or slope, shown in FIG. 7 in dotted lines is obtained by use of the slot 154 to raise or lower the rear of the seat pan 144. The seat pan will pivot on the bolts or pins 156 and 158. The tilt can be at a compound angle, that is the seat pan can have both a lateral tilt and fore and aft tilt. The downward tilt of the rear of the seat pan 144 is not very great but is adequate for most situations.

Further, the height of the seat pan 144 can be adjusted to a certain extent, as permitted by the slot adjustments, so that the seat pan bottom can protrude through the opening 139, or it can be lifted above the bottom wall 138.

The seat pan of course can tilt in the opposite direction from that shown in FIG. 8 for accommodating adjustment requirements.

The bedding can be custom fit as desired for a patient after the thigh support strips needed are selected and fastened in place.

The seat pan 144 may have a sleeve in the front that can be used to receive a support strap such as that shown at 90, to hold an additional support, such as a knee spreader, if desired.

While the pelvic support module 125 has been illustrated as having solid molded side, rear and lower walls, a frame for supporting the seat pan is all that is necessary. The angular adjustment of the seat pan can easily be accomplished. An open style framework is satisfactory with vertical members used in regions where the seat pan adjustment slots and support holes are shown.

Although the present invention has been described with reference to preferred embodiments, workers skilled in the art will recognize that changes may be made in form and detail without departing from the spirit and scope of the invention.

What is claimed is:

1. A modular structure for forming an orthotic seat comprising:

a pelvic support module, said pelvic support module having a base portion with upright side support walls, and a rear wall supported by the base portion;

a separate seat pan adjustably secured between the side support walls, the seat pan being adjustable about a first axis to permit tilting the seat pan about the first axis, the seat pan being adjustably tiltable about a second axis perpendicular to the first axis;

at least one fastener for securing the seat pan relative to the base portion in an adjusted position about the second axis;

at least one strut extending upwardly from the rear wall; and a thoracic module adjustably mounted for vertical movement on the strut and including a thoracic support having a back portion supported on the strut and extending forwardly, spaced apart side thoracic wall portions integral with the back portion positioned to engage and support a user on the separate seat pan.

2. The seat of claim 1, wherein the at least one strut comprises a single strut mounted substantially along an upright central line of the pelvic support module, the thoracic support module being slidably mounted on said single strut, and means to secure the thoracic module at a desired location along the length of said single strut.

3. The seat of claim 1, and a cervical support mounted above the thoracic module for supporting a head of a user of the seat pan.

4. The seat of claim 3, wherein the cervical support is mounted on a portion of the single strut, the single strut extending upwardly beyond the thoracic module.

5. The seat of claim 1, and a foot support mounted onto the pelvic module for adjustable positioning relative to the seat pan of the pelvic module.

6. The seat of claim 1, including a bedding material mounted on the pelvic module for supporting a user, said bedding material being conformed to fit to a user.

7. The seat of claim 1 wherein the seat pan has uprightly extending, spaced side walls and a back wall, that fit inside uprightly extending pelvic module side walls and the pelvic module back wall, aligning apertures formed in the side walls of the seat pan and the side support walls of the pelvic module base portion, and fasteners in the apertures for permitting adjustment of the seat pan about the first axis and for securing the side walls of the seat pan and the side support walls of the pelvic module base portion together.

8. A modular orthotic seat comprising standard sized modules custom fitted to a user including:

a pelvic seat module having a rear wall and side walls supported on a base portion for supporting a user;

a second module adjustably mounted relative to the pelvic support module for adjustment in a vertical direction and including integrally formed, yieldable thermoplastic side wall members conformable to fit the curvature of a thorax region of a user;

a cervical-head support adjustably mounted above the second module for limited vertical adjustment relative thereto; and a seat pan having uprightly extending spaced sidewalls, and a back wall integrally molded thereto, the seat pan having a bottom wall for supporting a user of the modular orthotic seat, the seat pan fitting within the side walls and rear wall of the pelvic seat module, and adjustable connections between the seat pan and walls of the pelvic seat module to permit tilting the bottom wall of the seat pan relative to the base portion of the pelvic seat module about two mutually perpendicular axes.

9. The seat of claim 8, and a strut providing for the adjustable mounting of the second module relative to the pelvic support module, said second module having a sleeve thereon that receives the strut, and means to permit adjustably securing the second module at a desired location along the strut.

10. A method of providing an orthotic seat for a user including the steps of:

providing a set of a plurality of different standard sizes of a pelvic support module having a base and a seat pan for a user of the orthotic seat, the seat pan being adjustably mounted to the base for adjustment about two mutually perpendicular axes;

providing a set of a plurality of different standard sizes of a thoracic support module for engaging a thorax of a user of the orthotic seat;

selecting from the standard sizes a pelvic support module and thoracic support module that are compatible for supporting a potential user;

adjustably mounting the pelvic support module and the thoracic support module together in a desired location to provide thorax support for a user seated on the pelvic support module;

adjusting the seat pan relative to the base about the two mutually perpendicular axes to a desired support location for a user of the orthotic seat; and providing padding on the modules for fitting the anatomy of a user.

11. The method of claim 10 including the steps of providing lateral support walls on the thoracic support module, and forming the support walls to fit a user along the sides of the thorax.

12. The method of claim 11 including the steps of adding auxiliary padding for fitting a user in at least one of the modules.

13. The method of claim 10 including the step of adjustably positioning a foot support on the pelvic support module.

14. An orthotic seat comprising:

a pelvic support module, said pelvic support module having a base portion, and wall portions on at least two sides thereof;

a separate seat pan supported on the pelvic support module; and adjustable connections for supporting the seat pan relative to the wall portions of the pelvic support module to permit inclining the seat pan about two mutually perpendicular axes, and releasable securing fasteners for securing the seat pan in selected positions individually about the two mutually perpendicular axes relative to a generally horizontal plane.

15. The seat of claim 14 wherein the seat pan has uprightly extending, spaced side wall portions and a back wall portion that fit inside the wall portions of the pelvic module, and fasteners selectively positioned in apertures in adjacent wall portions for securing wall portions of the seat pan and wall portions of the pelvic module together, with the seat pan in a selected position about the two mutually perpendicular axes.

16. The seat of claim 15 wherein the pelvic module includes substantially continuous sidewalls and a back wall molded as a unit.

17. An orthotic seat comprising:

a pelvic support module, said pelvic support module having a base portion including seat pan support portions;

a separate seat pan supported on the pelvic support module seat pan support portions;

the seat pan being adjustably secured to first seat pan support portions with a fastener to permit adjustably tilting and securing the seat pan about a first axis;

the first seat pan support portions providing a second axis of tilt for the seat pan perpendicular to the first axis; and a releasable fastener operable between the base portion and the seat pan to releasably restrain the seat pan from tilting about the second axis.

* * * * *